US009976340B2

(12) United States Patent
Bourassa et al.

(10) Patent No.: US 9,976,340 B2
(45) Date of Patent: May 22, 2018

(54) SYSTEM FOR REDUCING WARPING IN SOLID WOOD DOORS

(71) Applicant: Les Portes Alain Bourassa Inc., Terrebonne, Quebec (CA)

(72) Inventors: Mathieu Bourassa, Mascouche (CA); Alain Bourassa, Mascouche (CA)

(73) Assignee: LES PORTES ALAIN BOURASSA INC., Terrebonne (CA)

( * ) Notice: Subject to any disclaimer, the term of this patent is extended or adjusted under 35 U.S.C. 154(b) by 0 days. days.

(21) Appl. No.: 15/358,554

(22) Filed: Nov. 22, 2016

(65) Prior Publication Data

US 2017/0145736 A1 May 25, 2017

(51) Int. Cl.

| | |
|---|---|
| ***E06B 3/74*** | (2006.01) |
| *E06B 3/70* | (2006.01) |
| *E06B 3/964* | (2006.01) |

(52) U.S. Cl.

CPC ..... *E06B 3/74* (2013.01); *E06B 3/9649* (2013.01); *E06B 2003/7063* (2013.01)

(58) Field of Classification Search

CPC ..... E04C 3/04; E04C 3/07; E04C 2003/0421; E04C 2003/0473; E04C 3/47; E04B 2/7457; B21D 5/00; B21D 11/20; B21D 11/10

USPC ..... 29/897, 897.3, 897.31, 897.312, 897.33, 29/897.35

See application file for complete search history.

(56) References Cited

U.S. PATENT DOCUMENTS

| | | | | |
|---|---|---|---|---|
| 3,286,424 | A * | 11/1966 | Weyant | E04F 21/0007 49/501 |
| 4,281,479 | A * | 8/1981 | Daus | E06B 3/827 49/503 |
| 4,341,831 | A * | 7/1982 | Kleiss | C08J 5/124 156/313 |
| 5,791,047 | A * | 8/1998 | Skalka | B29B 17/0042 29/525.12 |
| 5,848,505 | A * | 12/1998 | Taylor | E06B 9/02 52/202 |
| 6,119,411 | A * | 9/2000 | Mateu Gil | E04B 1/94 109/80 |
| 6,250,040 | B1 * | 6/2001 | Green | E06B 3/72 52/455 |
| 6,434,899 | B1 * | 8/2002 | Fortin | E06B 5/164 49/501 |
| 6,619,010 | B2 * | 9/2003 | Wang Chen | E06B 3/825 49/501 |

(Continued)

FOREIGN PATENT DOCUMENTS

| | | | | |
|---|---|---|---|---|
| CA | 2836254 | A1 * | 6/2014 | E06B 5/11 |

*Primary Examiner* — Beth A Stephan
(74) *Attorney, Agent, or Firm* — Robert Brouillette; Brouillette Legal Inc.

(57) ABSTRACT

The invention described relates to the manufacturing of solid wood doors and consists in the insertion of steel reinforcing bars in the frames of the door to increase its rigidity. By increasing the rigidity of the door, the effect of possible warping in the door is diminished. In addition to this, alloying the steel, which possesses an elasticity modulus that is around ten times superior to that of wood, we achieve significantly higher rigidity for the piece of solid wood and this, by adding very little steel. The arrangement and the geometry of the reinforcing bars permit the conservation of traditional manufacturing techniques.

20 Claims, 6 Drawing Sheets

(56) References Cited

U.S. PATENT DOCUMENTS

| | | | | |
|---|---|---|---|---|
| 6,643,991 | B1 * | 11/2003 | Moyes | E06B 5/16 428/902 |
| 6,729,095 | B2 * | 5/2004 | Wang Chen | E06B 3/5892 49/501 |
| 6,745,526 | B1 * | 6/2004 | Autovino | E06B 3/74 52/232 |
| 9,482,044 | B2 * | 11/2016 | Wong | E06B 5/113 |
| 2003/0208972 | A1 * | 11/2003 | Reppermund | E06B 3/222 52/204.1 |
| 2004/0187428 | A1 * | 9/2004 | Ballantyne | E06B 3/74 52/656.4 |
| 2005/0034397 | A1 * | 2/2005 | Reppermund | E06B 3/222 52/455 |
| 2008/0168744 | A1 * | 7/2008 | Petersen | E06B 3/825 52/784.1 |
| 2008/0193771 | A1 * | 8/2008 | Korsgaard | E04B 1/943 428/418 |
| 2010/0058705 | A1 * | 3/2010 | Hanson | E06B 3/9649 52/656.4 |
| 2014/0053489 | A1 * | 2/2014 | Bryant | E06B 3/72 52/456 |
| 2014/0165886 | A1 * | 6/2014 | Yeremian | E06B 5/11 109/64 |

* cited by examiner

SYSTEM FOR REDUCING WARPING IN SOLID WOOD DOORS

CROSS-REFERENCE TO RELATED APPLICATIONS

The present patent application claims the benefits of priority of Canadian Patent Application No. 2,913,424, entitled "Système anti-gauchissement pour porte en bois massif", and filed at the Canadian Patent Office on Nov. 23, 2015, the content of which is incorporated herein by reference.

FIELD OF THE INVENTION

The invention relates to the field of doors, in particular the manufacturing of solid wood slab door.

BACKGROUND

Wooden doors have a certain level of weakness with respect to warping since wood reacts in a non uniform manner to heat and humidity. Therefore, when the external temperature decreases to zero and the interior of the home is more than 20° C., it is possible that the door undergoes warping. In another case, when it is very humid outside and very dry inside of the home, the wood pieces undergo a high level of stress due to the humidity differential.

OBJECTIVES OF THE INVENTION

The first objective is to increase the rigidity of the solid wood door in such a way as to avoid the modification of its appearance due to warping.

The invention is a system and method to prevent the wood from changing in dimensions over time in order to prevent the breaking of fibers that result from the effects of warping. The system and method preferably provides for low production costs while maximizing the rigidity, the result of which, with respect to a finished solid wood door product, is preferably undetectable to the naked eye.

Additionally, when holes are made for the door handle, it would be better to not have to pierce into a metal panel, which could damage tools and equipment.

The invention may permit traditional assembly techniques and methods with respect to all parts of the solid wood door and allow for its use as standard hardware.

SUMMARY OF THE INVENTION

The invention is first directed to a system for reducing warping in a solid wood door. The door comprising:

two vertical stiles running the full height of the door and defining the vertical edges of the door with a first stile comprising attaching elements for hingedly connecting the door to a door frame and a second stile, opposite to the first stile, optionally having a handle; and a top and bottom horizontal rail connecting the two vertical stiles and defining the top and bottom edges of the door; the stiles and rails delimiting a panel of the door having an external and an interior surface;

the system comprising at least one pair of longitudinal and parallel reinforcing bars embedded along almost the total length of the second stile of the door, the reinforcing bars being adjacent to the external and/or interior surfaces of the door in a way that the reinforcing bars match the external and/or interior surfaces of the door; the external and/or interior surface of the door being then optionally laminated for hiding the reinforcing bars.

The invention is also directed to a method for the making of a solid wood door with reduced warping properties. The door is defined as herein above. The method comprises the steps of:

(a) embedding at least one pair of longitudinal and parallel reinforcing bars within along almost the total length of the second stile of the door in a way that the reinforcing bars, once embedded, are adjacent to the external and/or interior surfaces of the door and that the reinforcing bars match the external and/or interior surfaces of the door;

(b) assembling the stiles, rails and panel to form the door; and (c) optionally, laminating the external and/or interior surface of the door for hiding the reinforcing bars.

The system and method for preventing warping according to the present invention is based on the principle of sandwiched beams. The center or core does not necessarily need to be composed of the same material as the external layers to achieve a rigid assembly. As a result, the external layers have a more important influence than the internal layers due to the laws pertaining to the calculation of inertial momentum.

In consideration of these laws, it is advantageous to place a maximum of material or parts of the door such as the stiles, reinforcing bars, hardware elements and any other composite part of the door as far as possible from the neutral axis of the door center or main beam center.

According to a preferred embodiment, steel is used for the making of the bars since it offers a very high elasticity modulus/$ per kilo. In addition to this, steel handles well and it is easy to procure at reasonable costs. This being said, titanium, stainless steel or any other material with a much higher elasticity modulus than the wood may be used.

The invention preferably consists in inserting the metal reinforcing bars inside the piece of solid wood while respecting certain constraints.

In one embodiment, the system comprises two pairs of longitudinal and parallel reinforcing bars, one pair of reinforcing bars being adjacent to the external surface of the door and the other pair being adjacent to the interior surface of the door.

In another embodiment, each pair of reinforcing bars are placed symmetrically with respect to a neutral axis along the length of the second stile.

In yet another embodiment, each pair of reinforcing bars comprises a reinforcing bar adjacent to the edge of the door that is smaller in width than the other reinforcing bar.

In yet another embodiment, a minimum distance between the edge of the door and the adjacent reinforcing bar is about 0.5 inch.

Preferably the steel is placed as close as possible to the external surface of the piece of wood. To make the piece as rigid as possible, the metal parts are preferably placed close to the external surface of the frame and close to the interior surface, and this, symmetrically while avoiding any changes in the desired appearance of the door.

The metal parts are to be as large in dimension as possible, all the while avoiding occupying the entire dimension of the piece since the wood is expected to vary in dimension with time, which can lead to constraints leading to the rupture of the fibers.

The reinforcing bars are to allow passage of hardware elements (example: the door knob and hinges).

The metal parts may be such that they are not to cause harm to the process of manufacturing and the assembly of the composite parts of the door (bolts, slots, grooves, panels, tenons, mortise, joints, studs, etc.)

The metal parts preferably run along almost the total length of the part.

The parts are not to be in contact with the environment and they are preferably to be completely sealed.

To reach these objectives, the stile is composed of a center or core that is grooved to permit the reinforcing bars to be encased or embedded. The reinforcing bars are attached to the door, preferably glued in these grooves. More preferably, a piece of wood is laminated on top of the reinforcing bars. In this way, the reinforcing bars are undetectable and the door rigidity is increased significantly.

In other words, in the preferred embodiment, the external and/or interior surface of the door define at least one groove, each groove being configured to embed the reinforcing bars that are attached to the door.

In another embodiment, the reinforcing bars are glued to the door within the groove.

In yet another embodiment, each groove has a width that is superior to a width of the reinforcing bar embedded therein forming a leeway to avoid constraints in the wood.

BRIEF DESCRIPTION OF THE FIGURES

The preceding description and other objectives, characteristics and advantages of the invention will be elucidated next in reference to the annexed figures in which.

DETAILED DESCRIPTION OF THE PREFERRED EMBODIMENTS

A system for preventing warping is described below. Although the invention is described in relation to a specified embodiment, it is understood that this preferred embodiment serves only as an example and that the invention is not limited to the features of the embodiments described and illustrated herein, but includes all variations and modifications within the scope and spirit of the disclosure.

Figure 1:
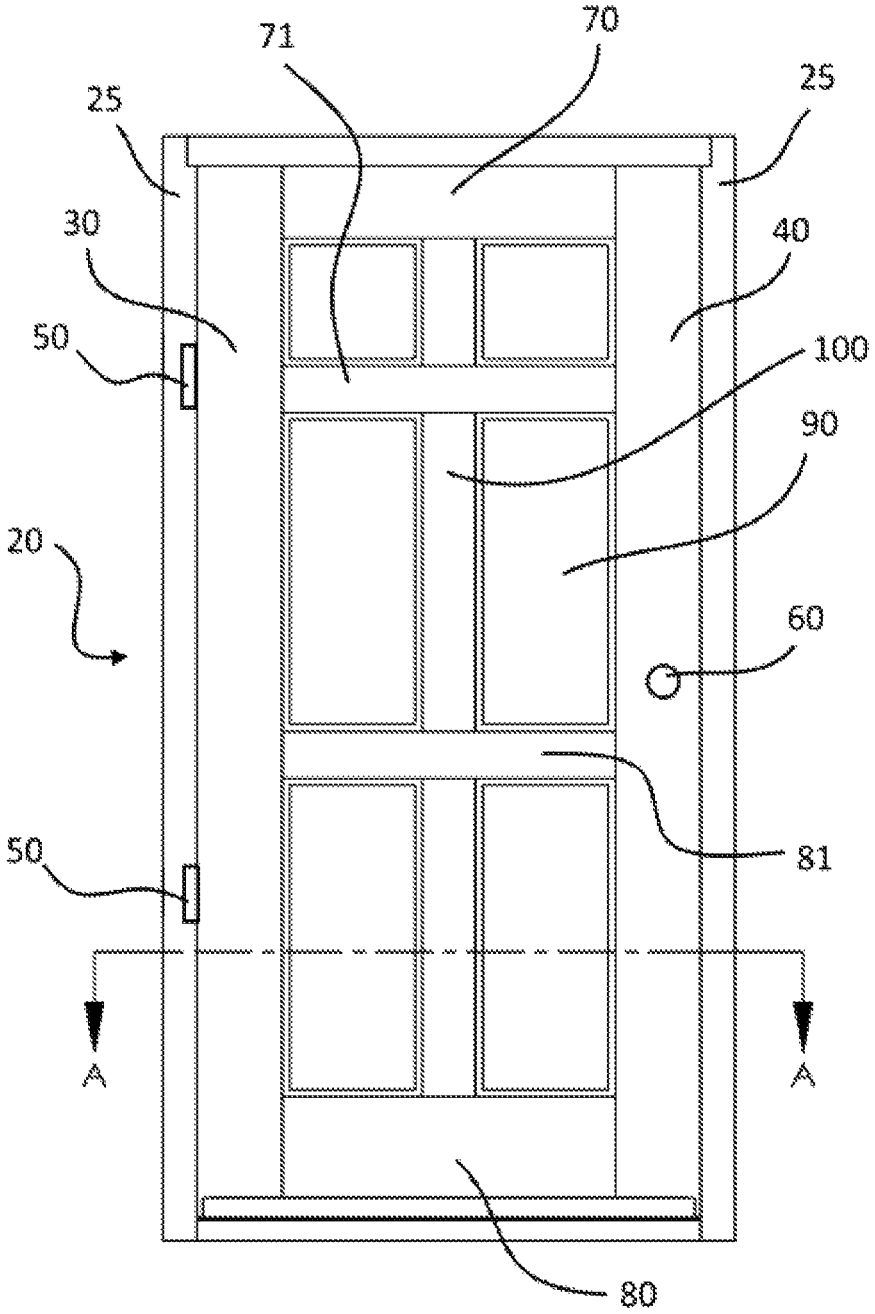
FIG. 1 illustrates a front view of the assembly of the door in the preferred embodiment of the invention.
Figure 2:
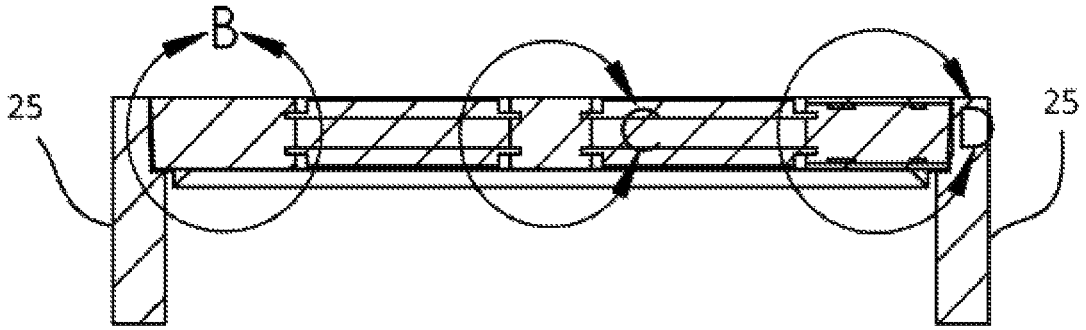
FIG. 2 is the cross-section AA presented in FIG. 1.

Referring to FIGS. 1 and 2, a door 20 comprises two vertical stiles 30, 40 running the full height of the door 20 and defining the vertical edges of the door 20 with a first stile 30 comprising attaching elements 50 for hingedly connecting the door 20 to a door frame 25 and a second stile 40, opposite to the first stile 30, optionally having a doorknob 60. A top and bottom horizontal rail 70, 80 connecting the two vertical stiles 30, 40 and defining the top and bottom edges of the door 20. The stiles 40, 100 and rails 71, 81 delimiting a panel 90 of the door 20 having an external and an interior surface.

Figure 3:
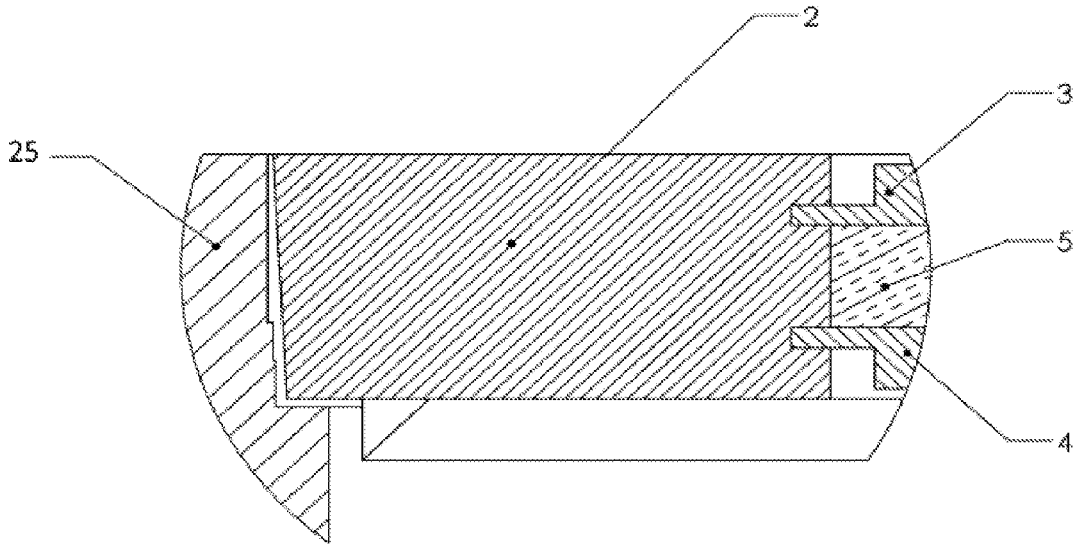
FIG. 3 shows detail B of the cross-section AA presented in FIG. 2. In the detailed view B, the manufacturing details of the stile on the side of the door hinges are shown.

Referring to FIG. 3 showing details B in FIG. 2, the manufacturing details of the stile 30 on the side of the door hinge element 50 are shown. This stile 30 is manufactured from one or many parts. The composite parts of the stiles 30, 40 are enumerated in the table below:

| Part | Description |
|---|---|
| 2 | Stile, |
| 3 | Internal panel, |
| 4 | External panel, |
| 5 | Panel insulation. |

Figure 4:
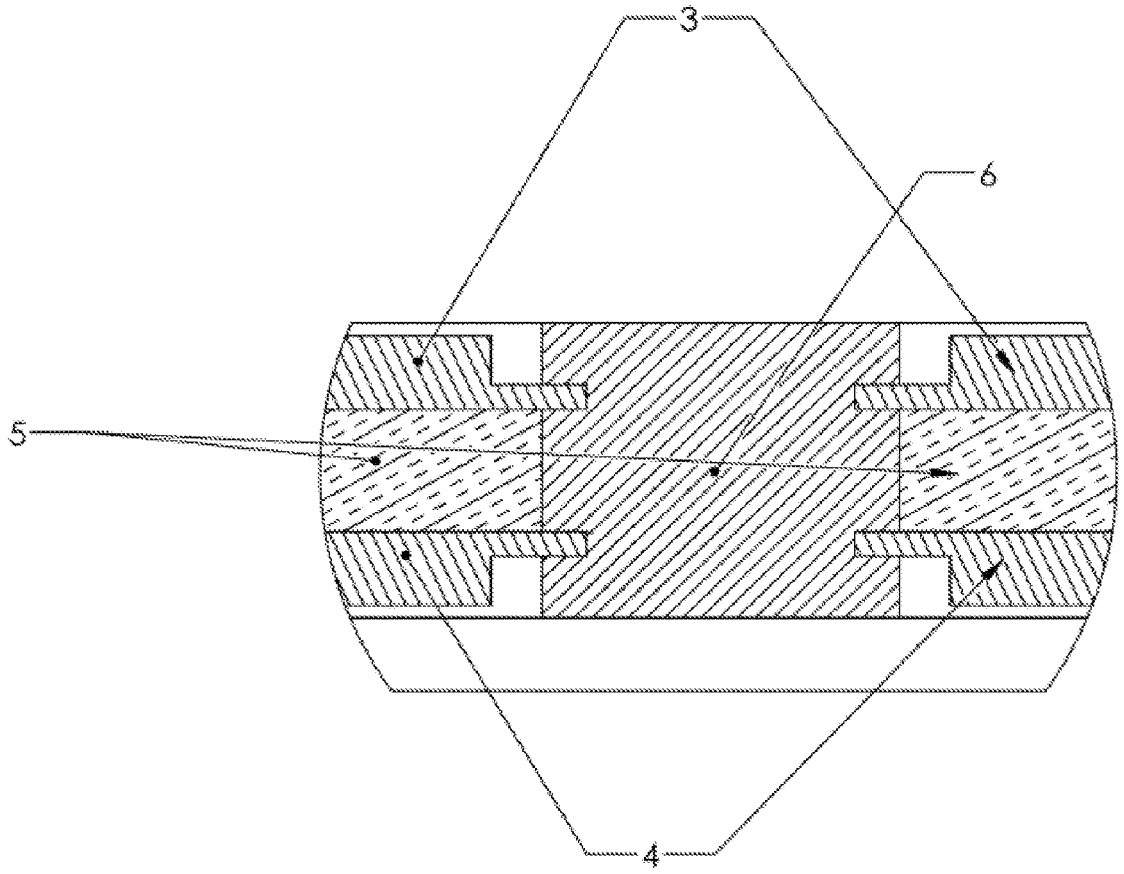
FIG. 4 shows detail C of the cross-section AA presented in FIG. 2. In the detailed view C, the manufacturing details of the intermediary stile are shown.

Referring to FIG. 4 showing details C in FIG. 2, the manufacturing details of the intermediary stile 100 are shown. The composite parts of the intermediary stile 100 are enumerated in the table below:

| Part | Description |
|---|---|
| 6 | Intermediary stile, |
| 3 | Internal panels |
| 4 | External panels |
| 5 | Panel insulation. |

Figure 5:
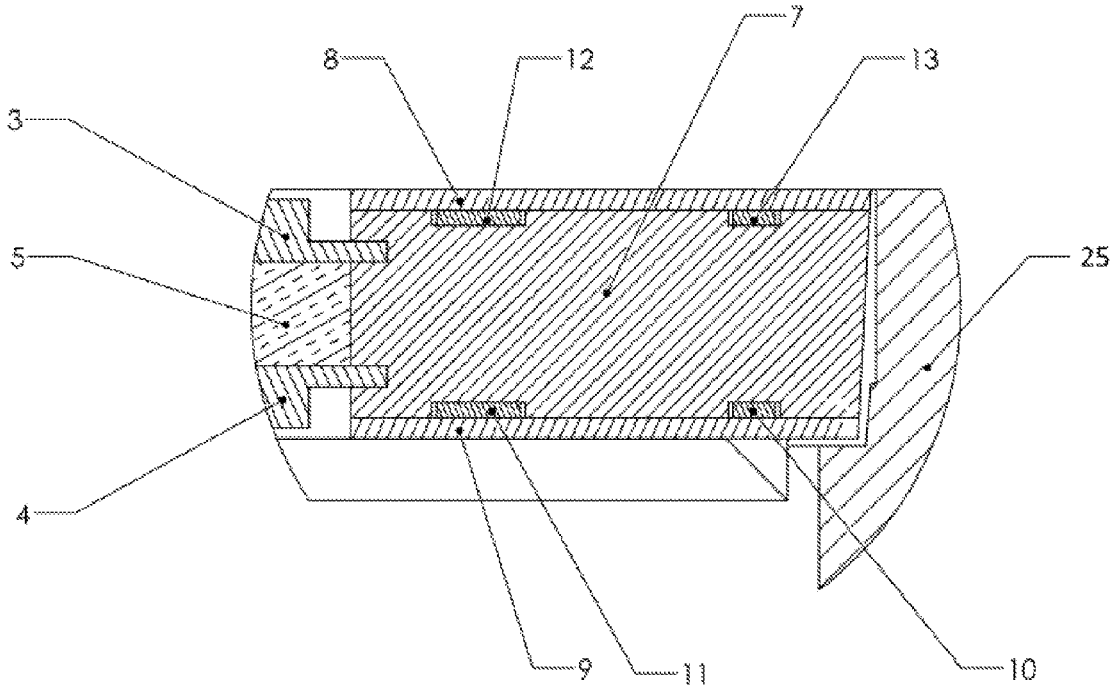
FIG. 5 shows detail D of the cross-section AA presented in FIG. 2. In the detailed view D, the manufacturing details of the stile on the side of the door knob is shown.

Referring to FIG. 5 showing details D in FIG. 2, the manufacturing details of the stile 40 on the side of the door knob 60 are shown. This stile 40 is manufactured with one or several parts. The composite parts of the stile are enumerated in the table below:

| Part | Description |
|---|---|
| 7 | Stile center or core |
| 8 | Internal veneer |
| 9 | External veneer |
| 3 | Internal panel |
| 4 | External panel |
| 5 | Panel insulation |
| 10 | Small steel external reinforcement |
| 11 | Large steel external reinforcement |
| 12 | Large steel internal reinforcement |
| 13 | Small steel internal reinforcement |

The system for preventing warping is composed of 4 steel reinforcing bars (parts 10, 11, 12, 13). These reinforcing bars (parts 10, 11, 12, 13) are inserted in the grooves manufactured on the external and internal surfaces of the stile center (part 7). Once the reinforcing bars (parts 10, 11, 12, 13) have been inserted in the grooves, they are covered by veneer (parts 8,9) or the like (parts 8 and 9).

Figure 6:
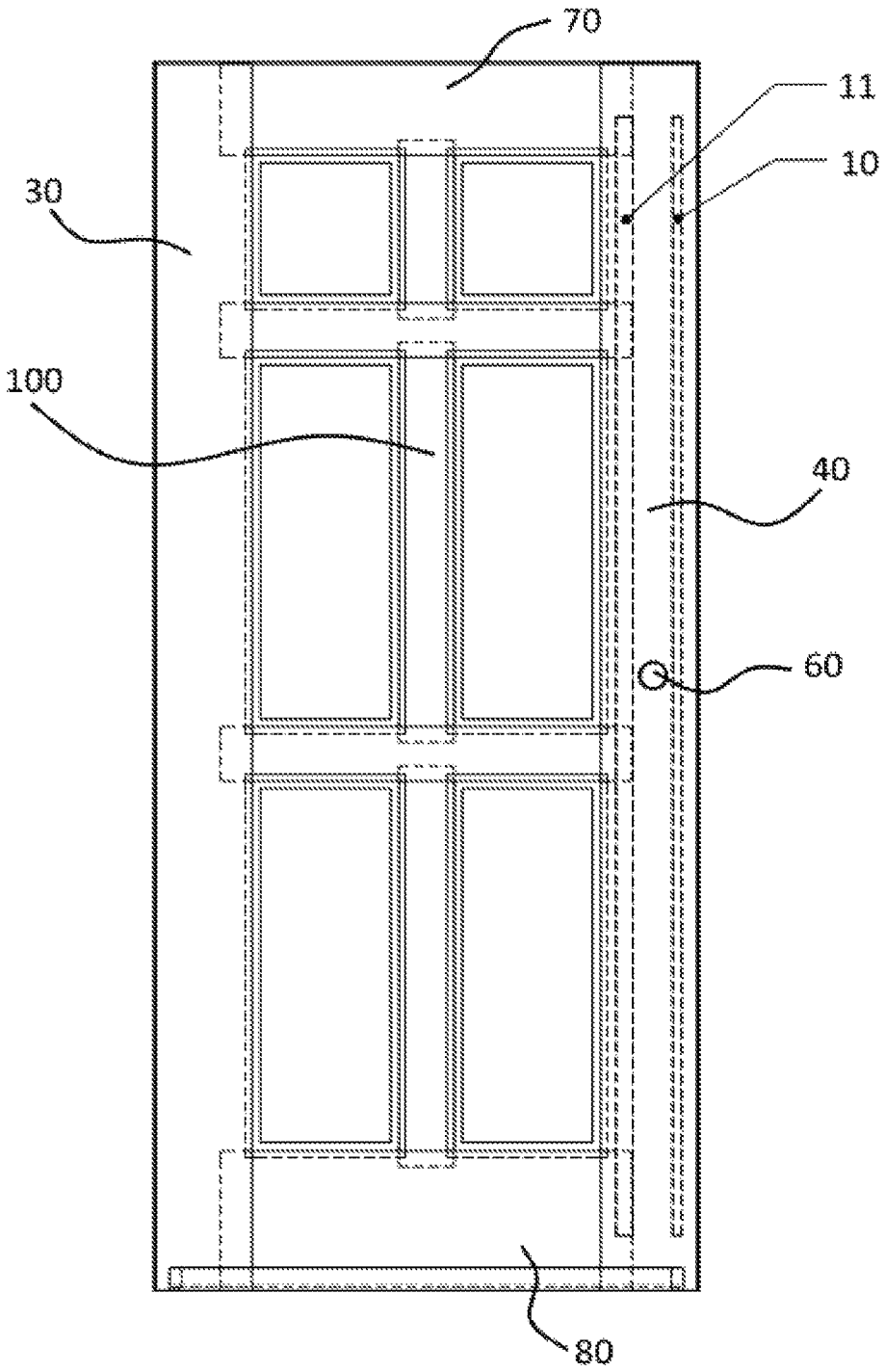
FIG. 6 illustrates a front schematic view of the assembly of the door according to a preferred embodiment of the invention.

Referring to FIGS. 5 and 6, the reinforcing bars (parts 10, 11, 12, 13) do not extend over the entire length of the stile 40; they stop a few inches from the two extremities. In addition to this, the system is not discontinuous at the door knob 60 level.

Material of the reinforcing bars (parts 10, 11, 12, 13): The most important characteristic of the material for the reinforcing bars (parts 10, 11, 12, 13) is the elasticity modulus. The elasticity modulus is preferably as high as possible in order to increase the rigidity of the piece of wood as much as possible while minimizing the dimension of the reinforcement reinforcing bars (parts 10, 11, 12, 13). The steel being used in the present invention is a construction type of steel without any particular characteristics. Since most of the steel available have very similar elasticity modulus, it is possible to use a wide array of different types of steel. The elasticity limit and plasticity limit of the material do not matter since the material will not be pushed to its limits. Since the steel reinforcing bars (parts 10, 11, 12, 13) are isolated from the external environment, the anti-corrosion properties of the material are not essential.

Alternative materials that may be used: All materials with an elasticity modulus equal to or higher than that of steel (around 186 GPa) may be used in the system for preventing warping. Aluminium may also be used for example.

Design of the reinforcing bars (parts 10, 11, 12, 13): Certain criteria are preferably respected during the design of the reinforcing bars (parts 10, 11, 12, 13) of the system for preventing warping. For example, for doors 20 with standard dimensions, it is recommended to respect the following characteristics:

- The size of the steel reinforcing bars (parts 10, 11, 12, 13) preferably do not exceed 1.5 inches, otherwise:
  - the steel and the veneer (parts 8,9) on the surface of the wood may delaminate.
  - the steel may completely prevent the wood from dimensionally changing and as a result the wood may crack,
  - pockets and bubbles may form between the reinforcing bars (parts 10, 11, 12, 13) and the veneer (parts 8,9).
- The minimum distance between the groove and the side of the part is to be around ½ inch.
- The distance between the reinforcing bars (parts 10, 11, 12, 13) is such that it is to permit the passage of standard hardware elements.
- The steel reinforcing bars (parts 10, 11, 12, 13) are to be continuous on almost the entire length of the part.
- The reinforcing bars (parts 10, 11, 12, 13) are to stop at 3 inches maximum from each extremity of the part.
- For a door 20 of 2¼ inches with a 1 inch thick cassette mortise, a surface veneer (parts 8,9) of ¼ of an inch, the maximum thickness of the reinforcing bars (parts 10, 11, 12, 13) is 3⁄16 inches. For a door 20 that is thicker, it is possible to increase the thickness of the reinforcing bars (parts 10, 11, 12, 13) in order to achieve maximum rigidity.
- The tolerance between the reinforcing bar (parts 10, 11, 12, 13) and its groove is to be around 0.010" in all directions.

Although the illustrated preferred embodiment of the invention has been described below, it is understood that the concepts of the invention may be incorporated and used in other embodiments and that the annexed claims are to be interpreted to include other embodiments, with the exception of any that are limited by the prior art.

The invention claimed is:

1. A system for reducing warping in a door, the door comprising:

two vertical stiles running a full height of the door and defining vertical edges of the door with a first stile comprising attaching elements for hingedly connecting the door to a door frame and a second stile, opposite to the first stile, optionally having a handle; and a top and bottom horizontal rail connecting the two vertical stiles and defining a top and a bottom edge of the door; the stiles and rails delimiting a panel of the door, the door having an external and an interior surface;

the system comprising at least one pair of longitudinal and parallel reinforcing bars embedded along almost a total length of the second stile of the door, the reinforcing bars being adjacent to the external or interior surfaces of the door in a way that the reinforcing bars match the external or interior surfaces of the door; the external or interior surface of the door being laminated for hiding the reinforcing bars.

2. The system of claim 1, wherein the system comprises two pairs of longitudinal and parallel reinforcing bars, one pair of the reinforcing bars being adjacent to the external surface of the door and the other pair of the reinforcing bars being adjacent to the interior surface of the door.

3. The system of claim 1, wherein the external or interior surface of the door define at least one groove, the grooves being configured to embed the reinforcing bars, the reinforcing bars being attached to the door.

4. The system of claim 3, wherein the grooves have a width that is larger than a width of the reinforcing bars embedded therein.

5. The system of claim 1, wherein the two vertical stiles are made of wood having a wood elasticity modulus and the reinforcing bars are made of a material having a material elasticity modulus, the material modulus elasticity modulus being higher than the wood elasticity modulus.

6. The system of claim 1, wherein each pair of the reinforcing bars are placed symmetrically with respect to a neutral axis along the length of the second stile.

7. The system of claim 6, wherein each pair of the reinforcing bars comprises one of the reinforcing bars larger than the other of the reinforcing bars, and the larger of the reinforcing bars being adjacent to an edge (one of the vertical edges) of the door.

8. The system of claim 1, wherein the panel of the door is made of the same material as the stiles.

9. The system of claim 4, wherein the reinforcing bars are placed to allow the passage of at least one hardware element and/or at least one composite part of the door.

10. The system of claim 9, wherein the at least one hardware element comprises a handle, a lock or a window; and the at least one composite part of the door comprises a bolt, a slot, a groove, tenon, mortise, stud or a panel.

11. The system of claim 10, wherein the stiles, the reinforcing bars, the at least one hardware elements and the at least one composite part of the door are placed as far as possible from a neutral axis of a center of the door.

12. The system of claim 1, wherein the stiles are made either of a composite material with a core of the stiles made of a different material than an external part of the stiles.

13. The system of claim 1, wherein the reinforcing bars are continuous along the entire height of the door, or wherein the reinforcing bars stop at about 3 inches from the top and bottom edges of the solid wood door.

14. A method for the making of a solid wood door with reduced warping properties, wherein the door is as defined in claim 1; the method comprising the steps of:

a) embedding the at least one pair of longitudinal and parallel reinforcing bars along almost the total length of the second stile of the door, in a way that the reinforcing bars, once embedded, are adjacent to the external or interior surfaces of the door and that the reinforcing bars match the external or interior surfaces of the door;

b) assembling the stiles, rails and panel to form the door; and c) laminating the external or interior surface of the door for hiding the reinforcing bars.

15. A system for reducing warping in a door, the door comprising:

two vertical stiles running a full height of the door and defining vertical edges of the door with a first stile comprising attaching elements for hingedly connecting the door to a door frame and a second stile, opposite to the first stile, optionally having a handle; and a top and bottom horizontal rail connecting the two vertical stiles and defining a top and a bottom edge of the door; the stiles and rails delimiting a panel of the door, the door having an external and an interior surface;

the system comprising at least one pair of longitudinal and parallel reinforcing bars embedded along almost a total length of the second stile of the door, one of the reinforcing bars being adjacent to the external surface of the door and the other of the reinforcing bars being adjacent to the interior surface of the door, the reinforcing bars matching said surfaces of the door; said surfaces of the door being laminated for hiding the reinforcing bars.

16. The system of claim 15, wherein the system comprises two pairs of longitudinal and parallel reinforcing bars, one pair of the reinforcing bars being adjacent to the external surface of the door and the other pair of the reinforcing bars being adjacent to the interior surface of the door.

17. The system of claim 15, wherein the external and interior surface of the door define at least one groove, the grooves being configured to embed the reinforcing bars, the reinforcing bars being attached to the door.

18. The system of claim 15, wherein the two vertical stiles are made of wood having a wood elasticity modulus and the reinforcing bars are made of a material having a material elasticity modulus, the material elasticity modulus being higher than the wood elasticity modulus.

19. The system of claim 15, wherein each pair of the reinforcing bars are placed symmetrically with respect to a neutral axis along the length of the second stile.

20. The system of claim 15, wherein each pair of the reinforcing bars comprises one of the reinforcing bars larger than the other of the reinforcing bars, and the larger of the reinforcing bars being adjacent to an edge (one of the vertical edges) of the door.

* * * * *